US005845781A

United States Patent [19]

Alico et al.

[11] Patent Number: 5,845,781

[45] Date of Patent: Dec. 8, 1998

[54] CONTAINER THAT CONVERTS INTO A COPYHOLDER

[76] Inventors: Robert J. Alico; Judith M. Alico, both of 808 Spindletree Ave., Naperville, Ill. 60565

[21] Appl. No.: 865,392

[22] Filed: May 29, 1997

[51] Int. Cl.[6] ..... B65D 5/52

[52] U.S. Cl. ..... 206/736; 206/424

[58] Field of Search ..... 206/45.2, 45.21, 206/45.28, 45.29, 45.25, 214, 215, 224, 371, 15, 308.1, 308.3, 387.1, 424, 752, 762, 736, 757, 759

[56] References Cited

U.S. PATENT DOCUMENTS

| | | | |
|---|---|---|---|
| 1,944,714 | 1/1934 | Lehmann | 206/752 |
| 1,955,252 | 4/1934 | Palla | 206/762 |
| 2,695,097 | 11/1954 | Easton | 206/45.21 |
| 3,009,565 | 11/1961 | Leone | 206/752 |
| 3,353,658 | 11/1967 | Ettin | 206/45.25 |
| 3,656,613 | 4/1972 | LaFrance et al. . | |
| 4,046,311 | 9/1977 | Voytko . | |
| 5,301,800 | 4/1994 | Kenny . | |
| 5,344,004 | 9/1994 | Meyer | 206/45.25 |
| 5,678,339 | 10/1997 | Marventano . | |

*Primary Examiner*—Paul T. Sewell
*Assistant Examiner*—Luan K. Bui
*Attorney, Agent, or Firm*—Dick and Harris

[57] ABSTRACT

The container that converts into a copyholder of the present invention is formed from a one-piece blank (1) of paperboard or the like and comprises integral folding tabs (21 & 22) attached to side flaps (15 & 17) respectively which are inserted into tab receiving slots (19 & 20) located on the same edge end of the front panel (2) thereof. The bottom panel (18) contains a tab (29) attached to the free end thereof. The top panel (16) contains two tab receiving slots, one slot (30) located along the opposite edge from the free edge and the other tab (31) located midway between the free edge and the folded edge. The container is used for packaging, storing or mailing by folding the side flaps (15 & 17) upwardly, inwardly and downwardly and folding the top panel (16) and the bottom panel (18) upwardly, inwardly and downwardly, inserting tab (29) into the tab receiving slot (30). The blank of the present invention can be folded into a copyholder by folding the side flaps (15 & 17) upwardly, inwardly and downwardly and folding the tabs (21 & 22) downwardly, inwardly and downwardly again and inserting them into the tab receiving slots (19 & 20) respectively in the front panel (2). The top panel (16) is folded downward and the bottom panel (18) is folded upward and then downward at the mid length fold line (27) and the tab (29) is inserted into the tab receiving slot (31). The copyholder will rest on the folded bottom panel (18) with folded tabs (21 & 22) protruding through the slots (19 & 20) of the front panel (2).

11 Claims, 8 Drawing Sheets

Figure 1:
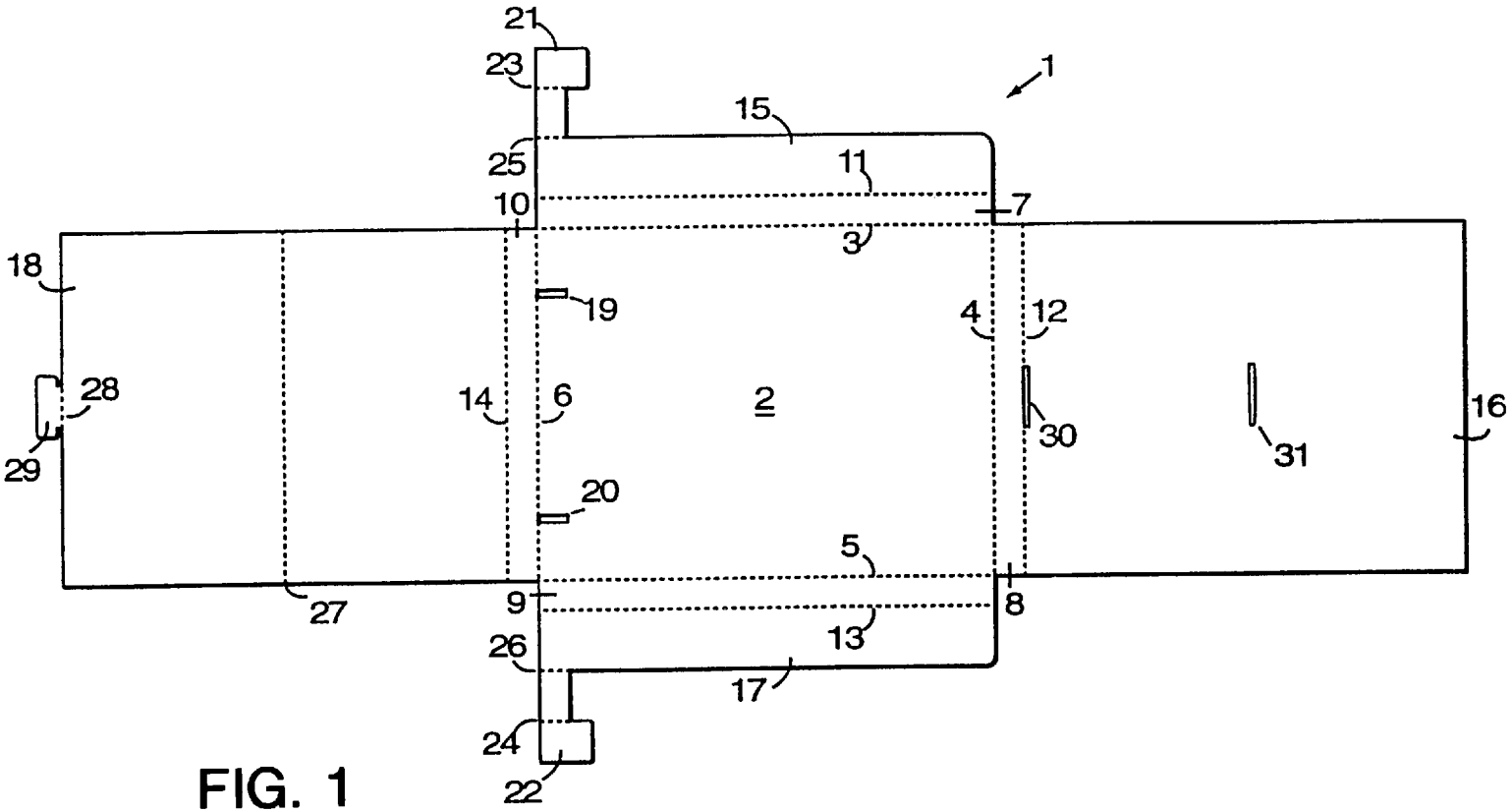

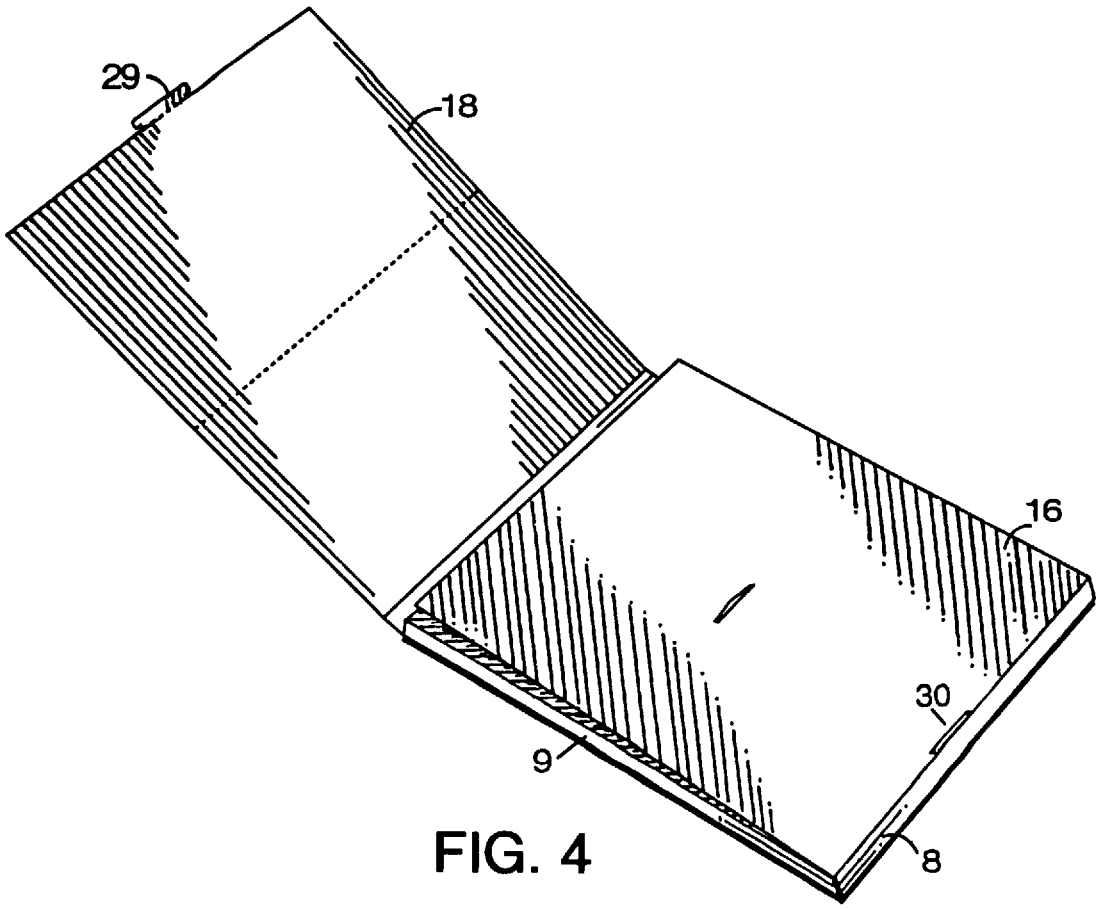
FIG. 4
FIG. 5
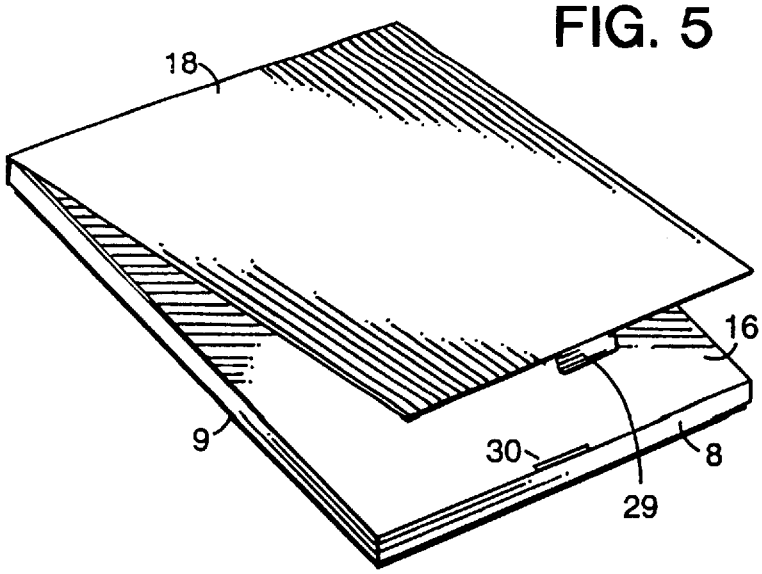

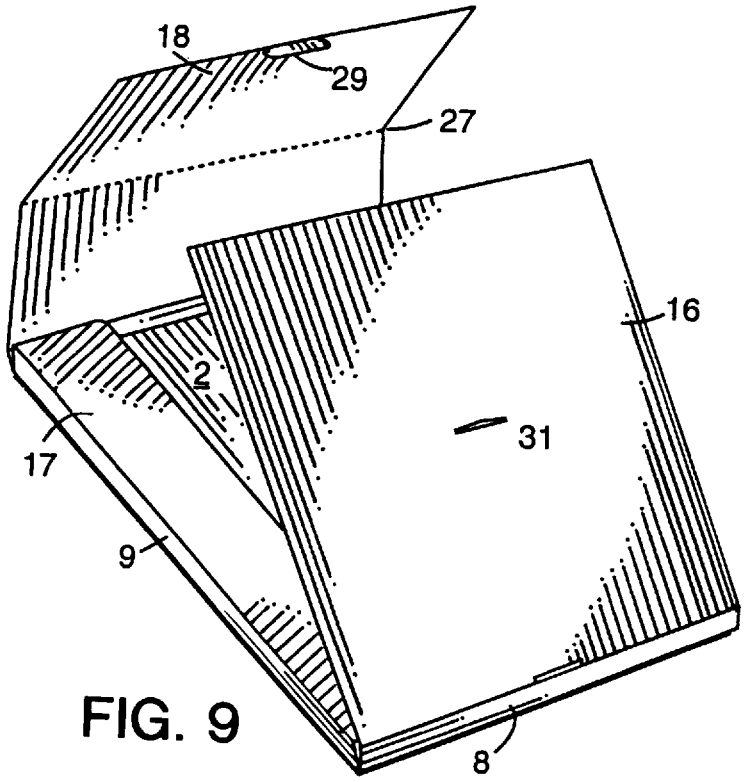
FIG. 9
FIG. 10
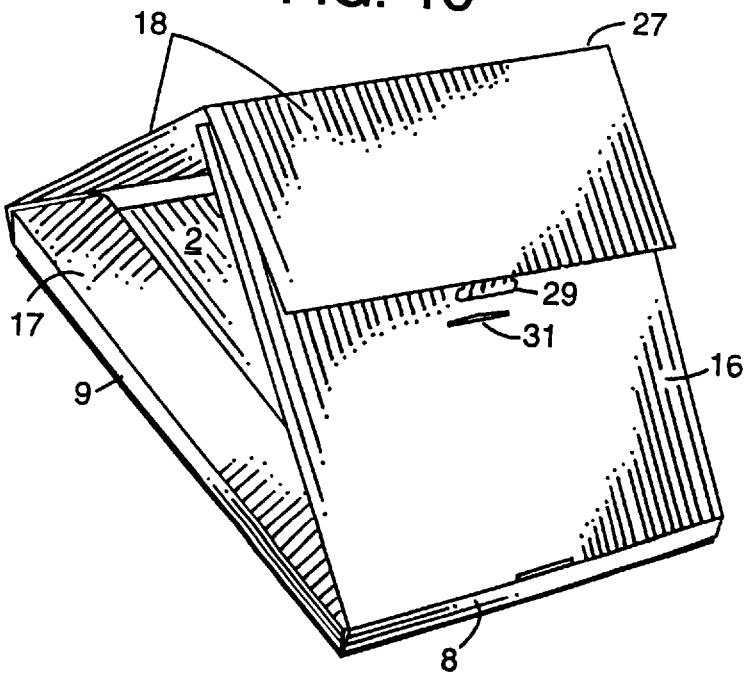

CONTAINER THAT CONVERTS INTO A COPYHOLDER

BACKGROUND

1. Field of Invention

The present invention relates to the field of packaging and more particularly, it relates to packaging that can be folded before or after use as a package into a copyholder.

2. Description of Prior Art

Packaging for the most part has been designed with a single use intended, that being to get an item form one point to another with no damage occurring to the contents. Seldom is packaging designed to have more than one functional use to the end consumer. In the market place today, virtually all packaging is designed to house the product and dispose of it after it arrives at its final destination for consumption or use.

Of the known prior art, all are formed from flat blanks. As shown in U.S. Pat. No. 5,301,800 (Kenney, 1994) in its erected form has a single use to display literature in a free-standing capacity. In U.S. Pat. No. 3,656,613 (LaFrance et al., 1972) in its erected form it is intended to house stranded material such as Christmas tree tinsel. As shown in U.S. Pat. No. 4,046,311 (Voytko, 1977) it relates to the field of packaging and more particularly mailing, which is intended to be used twice, between two addresses.

Similar to the above mentioned U.S. Patents, the container of the present invention is also formed from a blank of sheet material such as paperboard or the like. The container of the present invention is intended for packaging substantially rectangular objects, but obviously round, or objects having other shapes could also be successfully packaged in it. The container of the present invention can be reconfigured after being used as a package. The blank can be reconfigured to provide a useful function, that being a copyholder, comprising folding tabs and folding tab receiving slots.

SUMMARY OF THE INVENTION

The container that converts into a copyholder, for packaging generally objects that are wider and longer than they are deep, is formed form a single blank of sheet material such as paperboard or the like and includes a plurality of side walls, folding tabs and closure flaps. When folding as a container, the side flaps are folded inwardly over a packaged object in the first folding step. The top panel is folded inwardly over a packaged object in the second folding step. The bottom panel is folded inwardly over a packaged object and the tab inserted in the tab receiving slot in the third folding step.

When folding the container that converts to a copyholder into a copyholder, the first folding step is to fold the side flaps inwardly while the folding tabs are folded inwardly and inserted into folding tab receiving slots. In the second folding step the top panel is folded inwardly and folded inwardly again at the mid length fold line and the tab is inserted into the tab receiving slot.

Accordingly, it may be seen that the object of the container of the present invention provides a housing for a product safely without damage but also provides a useful function, that being a copyholder, therefore giving it a value-added function.

Additionally, it is relatively easy to customize the flat blank by printing it with material desired to be associated with its contents or for example informational, advertising or trademark material. Further objects and advantages of my invention will become apparent from a consideration of the drawings and ensuing description.

DRAWING FIGURES

Figure 2:
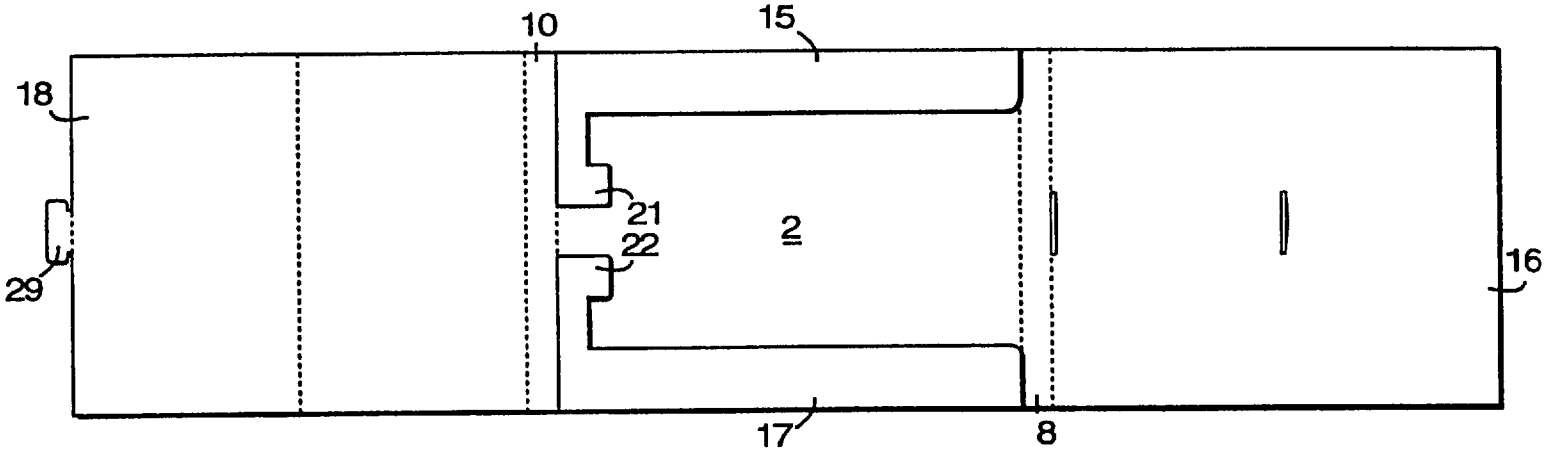
Figure 3:
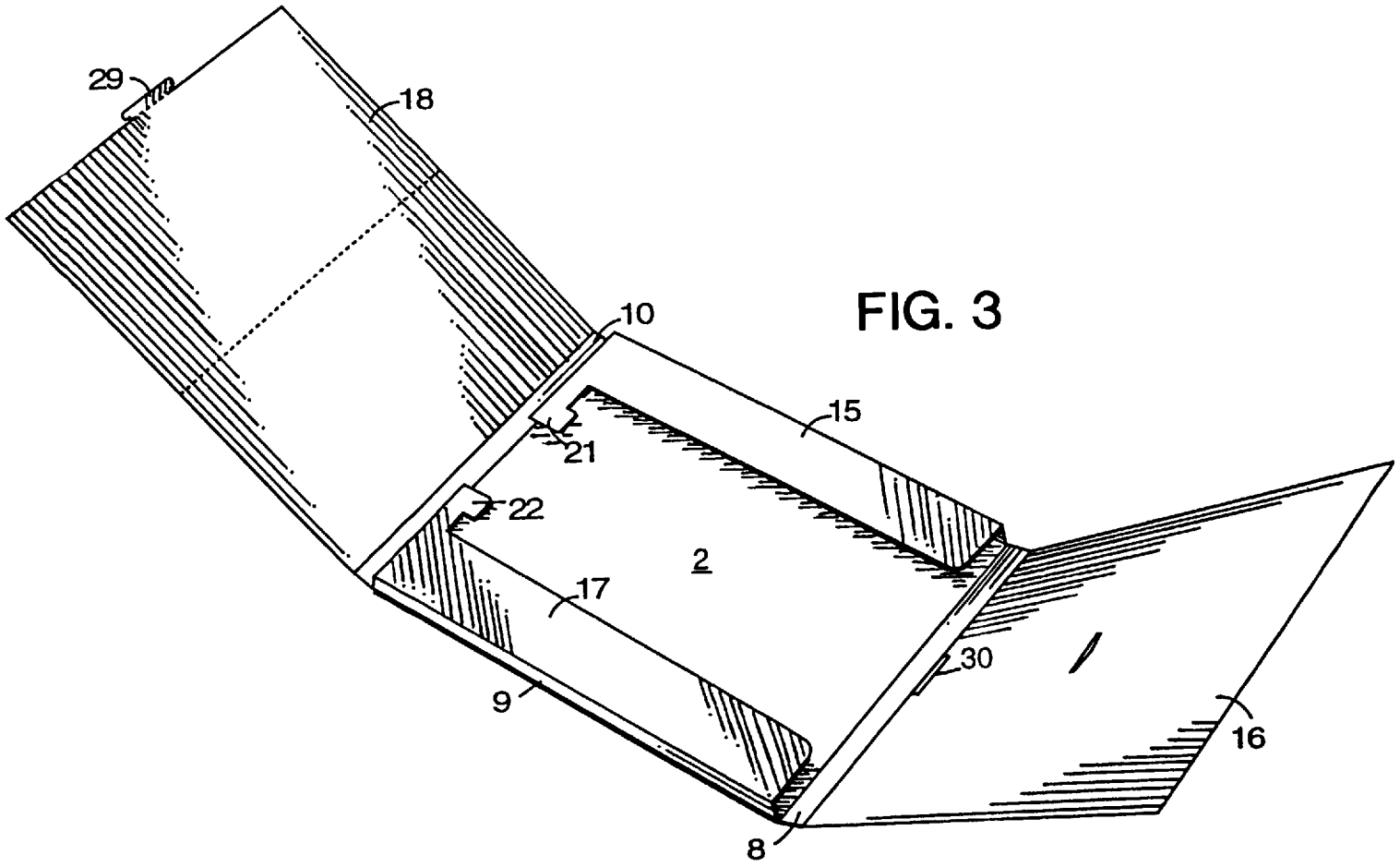
Figure 5B:
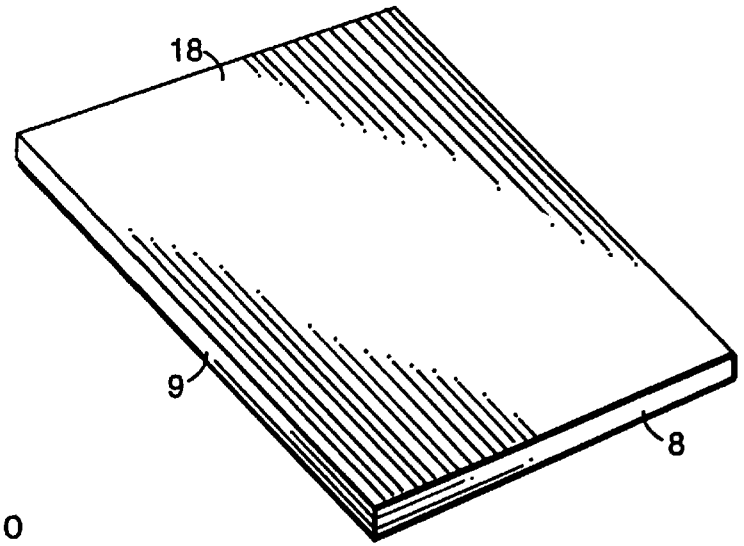
Figure 6:
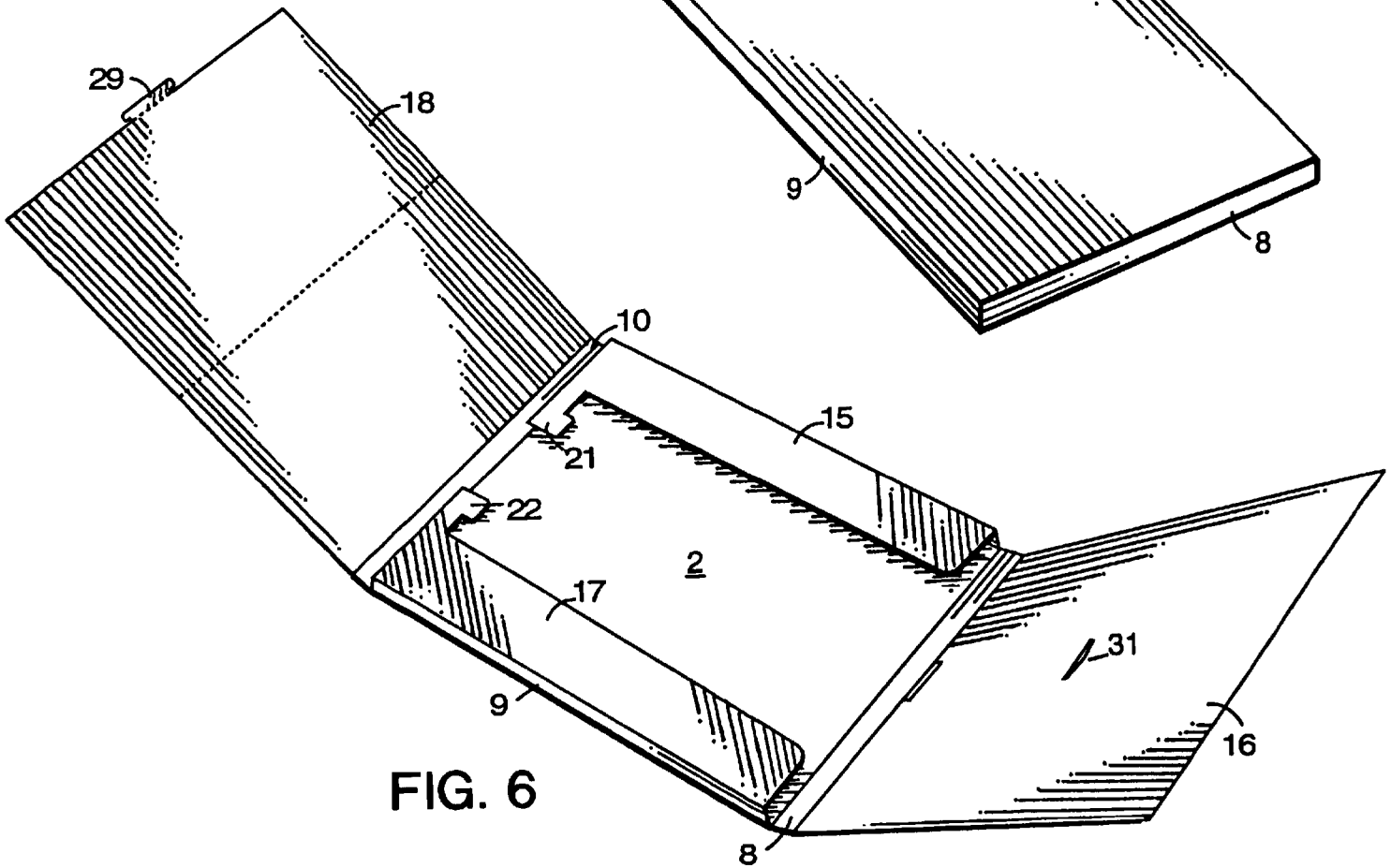
Figure 7:
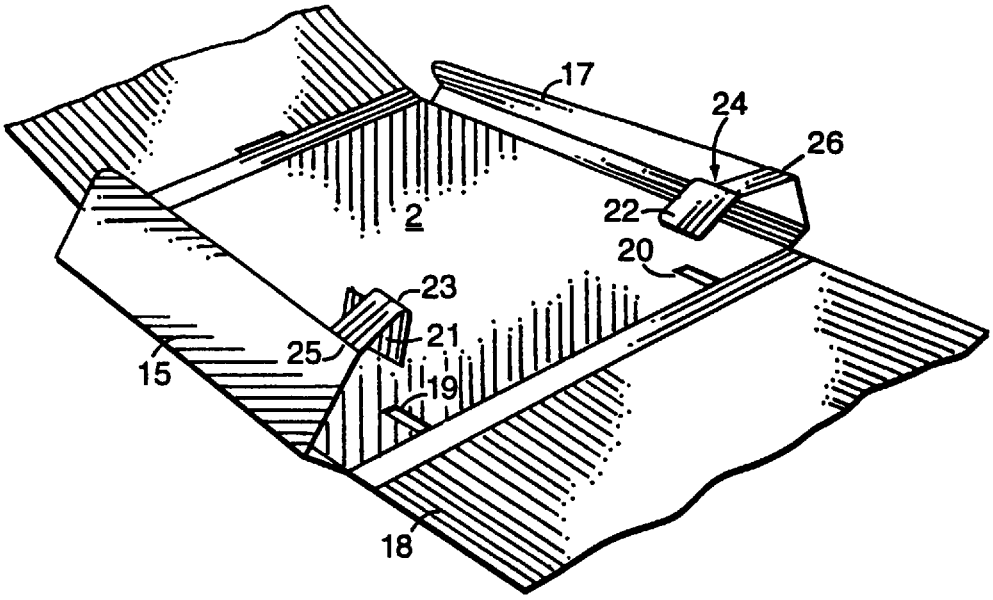
Figure 8:
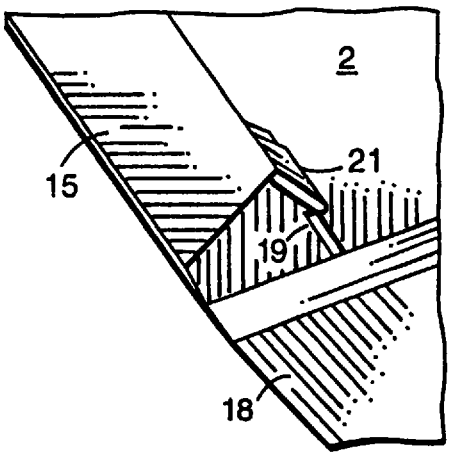
Figure 11:
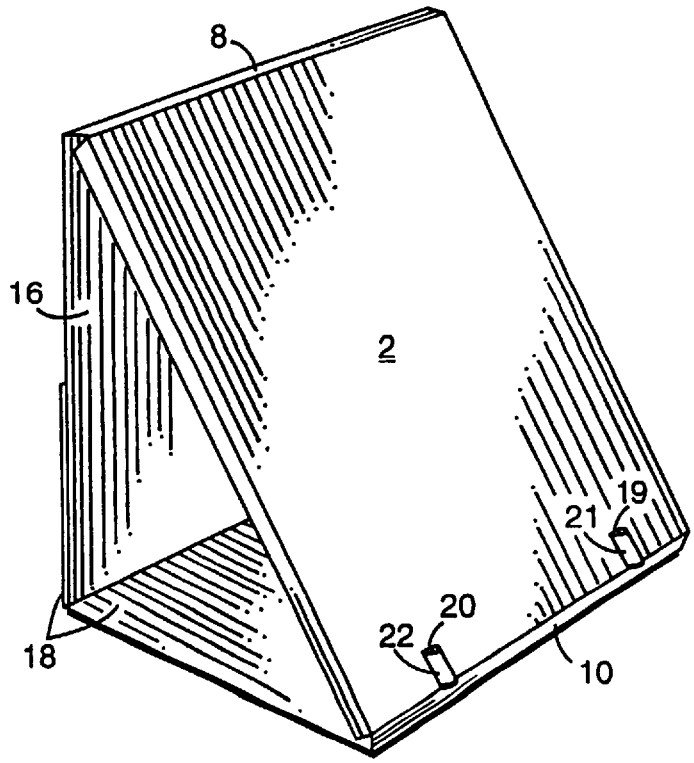

FIG. 1 shows a die cut flat blank with panels, walls, flaps, fold lines, tabs, and slots FIG. 2 shows side flaps folded inwardly and downwardly FIG. 3 shows bottom and top panels folded upwardly FIG. 4 shows top panel folded inwardly and downwardly FIG. 5 shows bottom panel folded inwardly and downwardly with tab folded downwardly FIG. 5B shows completed ¾ view of container FIG. 6 shows bottom and top panels folded upwardly and outwardly FIG. 7 shows folding tabs folded downwardly and inwardly FIG. 8 shows close-up of folding tab being inserted into folding tab receiving slot FIG. 9 shows bottom and top panels folded inwardly FIG. 10 shows bottom panel folded downwardly over top panel with tab being inserted in slot FIG. 11 shows completed ¾ view of copyholder with tabs protruding through front panel

| Reference Numerals in Drawings | | | |
|---|---|---|---|
| 1 | blank | 2 | front panel |
| 3–6 | fold lines | 7–10 | side walls |
| 11–14 | fold lines | 15 & 17 | side flaps |
| 16 | top panel | 18 | bottom panel |
| 19 & 20 | folding tab receiving slots | 21 & 22 | folding tabs |
| 23–28 | fold lines | 29 | tab |
| 30 & 31 | tab receiving slots | | |

DESCRIPTION

FIGS. 1 to 11

Referring now to the drawings in detail, and particularly to FIG. 1, there is shown a flat blank 1 of sheet material similar to paperboard or the like which is scored and cut to form the different panels, flaps, and tabs which make up the container of the present invention. Blank 1 includes a substantially quadrilateral front panel 2 separated from a plurality of side walls 7–10 by scored fold lines 3–6. The side walls 7–10 are of substantially the same shape and dimension for the packaging of a generally flat object of uniform thickness such as a book, tape cassette, compact discs, photographs, computer mouse pads, stationary, and the like. Thus, in general, the container of the present invention is intended for packaging substantially rectangular objects, but a round object or objects having other shapes could also be successfully packaged in the container of the invention as desired.

Further reference to FIG. 1 shown is a plurality of closure flaps 15–18 attached to the edges of side walls 7–10 along fold lines 11–14.

For the sake of a convenience of description, closure flaps 15 and 17 are referred to as side flaps 15 and 17 and closure flaps 16 and 18 are referred to as top panel 16 and bottom panel 18, respectively. Top panel 16 and bottom panel 18 are preferably dimensioned to have substantially the same width as the attached side wall panels 8 and 10 and to have a length substantially equal to front panel 2 which permits the top panel 16 and bottom panel 18 to fully overlap one another and the enclosed packaged object. Thus, the length of side flaps 15 and 17 is substantially equal to that of side wall panels 7 and 9. Side flaps 15 and 17 as shown in FIG. 1 are configured to have extensions designated folding tabs 21 and 22 that are along a line that is an extension of fold line 6, FIG. 1, that extends a length that is substantially equal to the combined width of side flap 15 and side wall panel 7 or substantially equal to the combined width of side flap 17 and side wall 9. Folding tab 21, starting as fold line 25 and continuing to fold line 23, should be substantially equal in length to the width of side wall panel 7. Folding tab 22, starting at fold line 26 and continuing to fold line 24, should be substantially equal in length to the width of side panel 9. Folding tab 21, from fold line 23 and continuing to its free side edge is substantially equal to a predetermined width and length. Folding tab 22, starting at fold line 24 and continuing to its free side edge is substantially equal to a predetermined width and length.

Top panel 16 and bottom panel 18 are preferably dimensioned to have substantially the same width as the attached side wall panels 8 and 10 and to have a length substantially equal to front panel 2 which permits the top panel 16 and bottom panel 18 to fully overlap one anther and the enclosed packaged object. Top panel 16 further includes a tab receiving slot 30 located substantially equal to half the distance from the outer free edge fold line 12 connecting top panel 16 to side wall 8 along fold line 4 and a tab receiving slot 31 located substantially midway in the center of top panel 16. As shown in FIG. 1, bottom panel 18 further includes a fold line 27 located substantially midway in the center of the panel and a single tab 29 attached substantially centrally of the outer free edges of bottom panel 18 along fold line 28. The tab has a nominal width as defined by the length of fold line 28, which is inserted in tab receiving slot 30 or 31 depending on the configuration desired. Each of the tab receiving slots 30 and 31 are dimensioned to have a predetermined size that is substantially equal to the thickness of the material from which blank 1 is made and a length that is substantially equal to the nominal width of tab 29. Thus, when tab 29 is inserted in the tab receiving slot 30 or 31 it becomes engaged behind the outer edge of the respective slot to securely hold the container together. Front panel 2 further includes two tab receiving slots 19 and 20 located along fold line 6 and dimensioned to have a width double the thickness of the material from which blank 1 is made and a length substantially equal to tab 21 at fold line 23 and tab 22 at fold line 24 respectively.

FIG. 2 shows the condition of blank 1 with side flaps 15 and 17 folded upwardly and inwardly. Folding tabs 21 and 22 are shown as unfolded.

FIG. 3 illustrates the next folding sequence for closing a packaged object in the container. In this sequence, bottom panel 18 and top panel 16 is being folded upwardly at side wall panel 10 and side wall panel 8 respectively. Tab 29 is being folded upwardly also.

FIG. 4 illustrates closing bottom panel 16 upwardly, inwardly and downwardly over side flaps 15 and 17 as the second folding step in packaging an object for marketing or mailing.

FIG. 5 shows bottom panel 18 almost completely folded downwardly with tab 29 about to be inserted in tab receiving slot 30. The container is finally in its closed condition when tab 29 is fully inserted in tab receiving slot 30 as shown in FIG. 5B.

FIG. 6 shows when the container is opened. Tab 29 is pulled upwardly out of slot 30 and bottom panel 18 and top panel 16 are moved upwardly and backwardly.

FIG. 7 illustrates folding tabs 21 and 22. Folding tab 21 is folded downwardly and inwardly at fold line 23 and then downwardly at fold line 25. Folding tab 22 is folded downwardly and inwardly at scored fold line 24 and then downwardly at fold line 26.

FIG. 8 shows a close view of folding tab 21 being inserted downwardly into folding tab receiving slot 19. Folding tab 22 will be inserted downwardly into folding tab receiving slot 20 (not shown).

FIG. 9 shows top panel 16 folded upwardly and inwardly as before. Bottom panel 18 is being folded upwardly and inwardly as before but now is also being folded downwardly at fold line 27.

FIG. 10 shows bottom panel 18 being folded downwardly along fold line 27. Tab 29 is inserted into tab receiving slot 31 which is dimensioned to have a width that is substantially equal to the thickness of the material from which blank 1 is made and a length that is substantially equal to the nominal width of tab 29. Thus, when tab 29 is inserted in the tab receiving slot 31 it securely holds bottom panel 18 in place.

FIG. 11 shows a three-quarter view of the container folded to function as a copyholder with folded tabs 21 and 22 protruding through the surface of front panel 2 at tab receiving slots 19 and 20 respectively. Copy or any other similar written or printed matter is placed on folded tabs 21 and 22 and rests backwardly against the surface of front panel 2.

Conclusion, Ramifications, and Scope

Thus, the reader will see the container that converts into a copyholder of the invention provides a reliable, economical device to house a product and provides the user a useful desk accessory after purchasing the product enclosed. As a stand-alone item, it provides an economical copyholder for the end user.

While my above description contains many specificities, these should not be construed as limitations on the scope of the invention, but rather as an exemplification of one embodiment thereof. Many other variations are possible. For example, the bottom panel could have more than one tab and the top panel could have more than one tab receiving slot. The panels and side flaps can be made from separate material. The folding tabs have several variations possible such as notches in the top where the copy rests, or they can be made of material that is detached from the blank. The blank can be made from a sheet plastic material or the like. It can be direct printed or graphics can be laminated to it. The copyholder of this invention can also be used as a display stand for product or literature.

Accordingly, the scope of the invention should be determined not by the embodiments illustrated, but by the appended claims and their legal equivalents.

We claim:

1. A shipping-display container apparatus convertible, through articulation, from a fully enclosable article-containment position to a substantially upright, article-display position, said apparatus comprising:

a front panel;

at least four side panels operably associated with and contiguously formed about the front panel so as to be oriented, upon articulation to the article-containment position, in successive side to side abutment about the periphery of said front panel;

a top panel operably associated, upon articulation to said article-containment position, with said at least four side panels, said four side panels being interposed, in said article-containment position, between the top and front panels;

one of said top and front panels forming an article support surface positionable in a substantially upright orientation when said apparatus is articulated to said article-display position, towards retention and display of said article along said one of said top and front panels;

the other of said top and front panels assisting in maintaining said one of said top and front panels in said substantially upright position upon articulation to said article-display position, said top and front panels being positioned at a non-parallel angle relative to each other, upon articulation to said article-display position;

an article support ledge along the exposed surface of said one of said top and front panels, for supporting said article in said article-display position;

said article support ledge being formed from at least a portion of one of said top, front and said at least four side panels; and ledge support means for maintaining said article support ledge in restrained, yet removable, position along said one of said top and front panels so as to maintain said displayed article in position adjacent said one of said top and front panels, when said apparatus has been articulated to said article-display position.

2. The apparatus according to claim 1 wherein two of said at least four side panels each include a side panel extension tab, each of said side panel extension tabs further includes an article support ledge member, said article support ledge members, upon said conversion, forming at least a portion of said article support ledge.

3. The apparatus according to claim 2 wherein said other of said front and top panels includes at least two tab receiving slots for the respective aligned receipt of each of said article support ledge members for supporting said article in said article-display position.

4. The invention according to claim 1 in which said apparatus further includes a bottom panel operably attached to one of said at least four side panels in a position substantially opposite said top panel, said bottom panel substantially overlapping said top panel, upon articulation to said article-containment position.

5. The apparatus according to claim 4 wherein the bottom panel includes a bottom panel tab, said tab operably positioned so as to be capable of releasably, and alternatively, restraining said apparatus into each of said article-containment and said article-display positions.

6. The apparatus according to claim 5 wherein said top panel includes a first and a second tab receiving slot, said first slot receiving said bottom panel tab in said article-containment position, and said second slot receiving said bottom panel tab in said article-display position.

7. The apparatus according to claim 6 wherein the bottom panel includes a fold line, said fold line operably positioned so that, upon articulation to said article-containment position, said tab is capable of releasable mating engagement with said first tab receiving slot;

said fold line operably positioned so that, upon articulation to said article-display position, said tab is capable of releasable mating engagement with the second tab receiving slot; and said fold line articulated to form a substantially horizontal maintaining means.

8. The apparatus according to claim 1 wherein the articles being shipped by the apparatus in its article-containment position comprise the articles being displayed by the apparatus in its article-display position.

9. The invention according to claim 1 wherein the apparatus is a substantially flat unitary blank of material.

10. The invention according to claim 9 wherein said blank is formed of paper material.

11. The invention according to claim 10 wherein said paper material comprises corrugated paperboard.

* * * * *